US005438310A

United States Patent [19]

Ikari

[11] Patent Number: 5,438,310

[45] Date of Patent: Aug. 1, 1995

[54] FUSE BOX

[75] Inventor: Akira Ikari, Shizuoka, Japan

[73] Assignee: Yazaki Corporation, Japan

[21] Appl. No.: 115,329

[22] Filed: Sep. 2, 1993

[30] Foreign Application Priority Data

Sep. 4, 1992 [JP] Japan ..... 4-237134

[51] Int. Cl.[6] ..... H01H 85/22

[52] U.S. Cl. ..... 337/208; 337/186; 337/191; 337/201

[58] Field of Search ..... 337/186, 187, 188, 189, 337/190, 191, 197, 201, 208, 209

[56] References Cited

U.S. PATENT DOCUMENTS 4,238,140 12/1980 Cairns et al. ..... 339/186 M
4,403,155 9/1983 Aoki et al. ..... 361/331
5,171,293 12/1992 Umemoto et al. ..... 439/622
5,215,479 6/1993 Araki et al. ..... 439/622

FOREIGN PATENT DOCUMENTS 59-115544 8/1984 Japan .
63-14342 1/1988 Japan .
63-127055 8/1988 Japan .

*Primary Examiner*—Lincoln Donovan
*Attorney, Agent, or Firm*—Wigman, Cohen, Leitner & Myers

[57] ABSTRACT

A fuse box for distributing current derived from a battery through a plurality of fuses, includes a main power source box to be connected to the battery, a sub-power source box to be integrated with the main power source box, mechanical coupling for mechanically coupling the main power source box with the sub-power source box, and electrical coupling for electrically coupling the main power source box with the sub-power source box.

9 Claims, 4 Drawing Sheets

FUSE BOX

BACKGROUND OF THE INVENTION

1. Technical Field

The present invention relates to a fuse box including fusible links to be provided in the electric system of automobiles.

2. Background Art

As the fuse box to be provided in the electric system of automobiles, there are two types, one having a divided structure and the other an integrated structure.

The divided structure type comprises one fuse box directly attached to the battery and another fuse box for receiving power supply from the one fuse box. In this case, the one fuse box is mechanically supported by the battery through a conductive bracket coupled to a metal terminal directly attached to the battery terminal, and is also electrically connected to the battery through the metal terminal and bracket. That is, both the bracket and metal terminal act as electrical and mechanical connecting members, respectively. Such a structure is disclosed in, for example, Japanese Utility Model Registration Application for Disclosure No.(SHO)59-115544.

On the other hand, the integrated structure type includes a portion for connecting the electric wire of the battery at a corner portion of the fuse box, so as to enable the power supply from battery to fuse box by connecting the contact portion of fuse box and the distal terminal of wire by screwing with a bolt after mounting the fuse box on the vehicle body in an assembly line. This structure is disclosed in, for example, Japanese Utility Model Registration Application for Disclosure No.(SHO)63-127055.

For the parts makers producing fuse boxes, however, if the integrated structure type fuse box is adopted for such wiring as mentioned above, the wire harness becomes considerably thick so that the workability of wiring and assembly becomes poor and the productivity is degraded.

On the other hand, for the automobile makers, the above-mentioned bolt screwing to such a thick wire flowing a large current must be required at many places, thereby degrading the productivity.

Thus, it is proposed to deliver the divided structure type fuse box to the automobile makers in a divided state, so that each automobile maker can mount the divided fuse box on the vehicle body. Because the divided structure type fuse box is more flexible in handling than the integrated structure type, it is advantageous for the parts makers that both the mounting work on assembly line and the wire connecting work can be facilitated.

However, for the automobile makers, the workability of mounting to the vehicle body becomes degraded because both the work for connecting the one divided fuse box to the battery and the work for bolt-screwing the wire from the one fuse box on the battery side to the other fuse box must be required.

Moreover, in the divided structure type fuse box the bracket for receiving power supply from the battery also works as mechanical connecting member. Thus, the reliability of electrical connection is likely to be lowered by looseness or breakage caused by vibration or the like reason.

SUMMARY OF THE INVENTION

Therefore, it is an object of the present invention to provide a fuse box with a divided structure, in which the respective divided box members can be integrated with each other, and the so-integrated structure can enhance the reliability of electrical connection.

To achieve the above object, the present invention provides a fuse box for distributing current derived from a battery through a plurality of fuses, includes a main power source box to be connected to the battery, a sub-power source box to be integrated with the main power source box, mechanical coupling for mechanically coupling the main power source box with the sub-power source box, and electrical coupling for electrically coupling the main power source box with the sub-power source box.

In the above-mentioned fuse box of the present invention, the mechanical and electrical connections between the main power source box and sub-power source box are carried out by separated means, respectively. Accordingly, the electrical connection can be maintained under a good condition without being influenced by the state of mechanical connection.

These and other objects, features and advantages of the present invention will be more apparent from the following description of a preferred embodiment, taken in conjunction with the accompanying drawings.

DESCRIPTION OF THE PREFERRED EMBODIMENT

Hereinafter, one embodiment of the present invention will be described with reference to the drawings.

Figure 1:
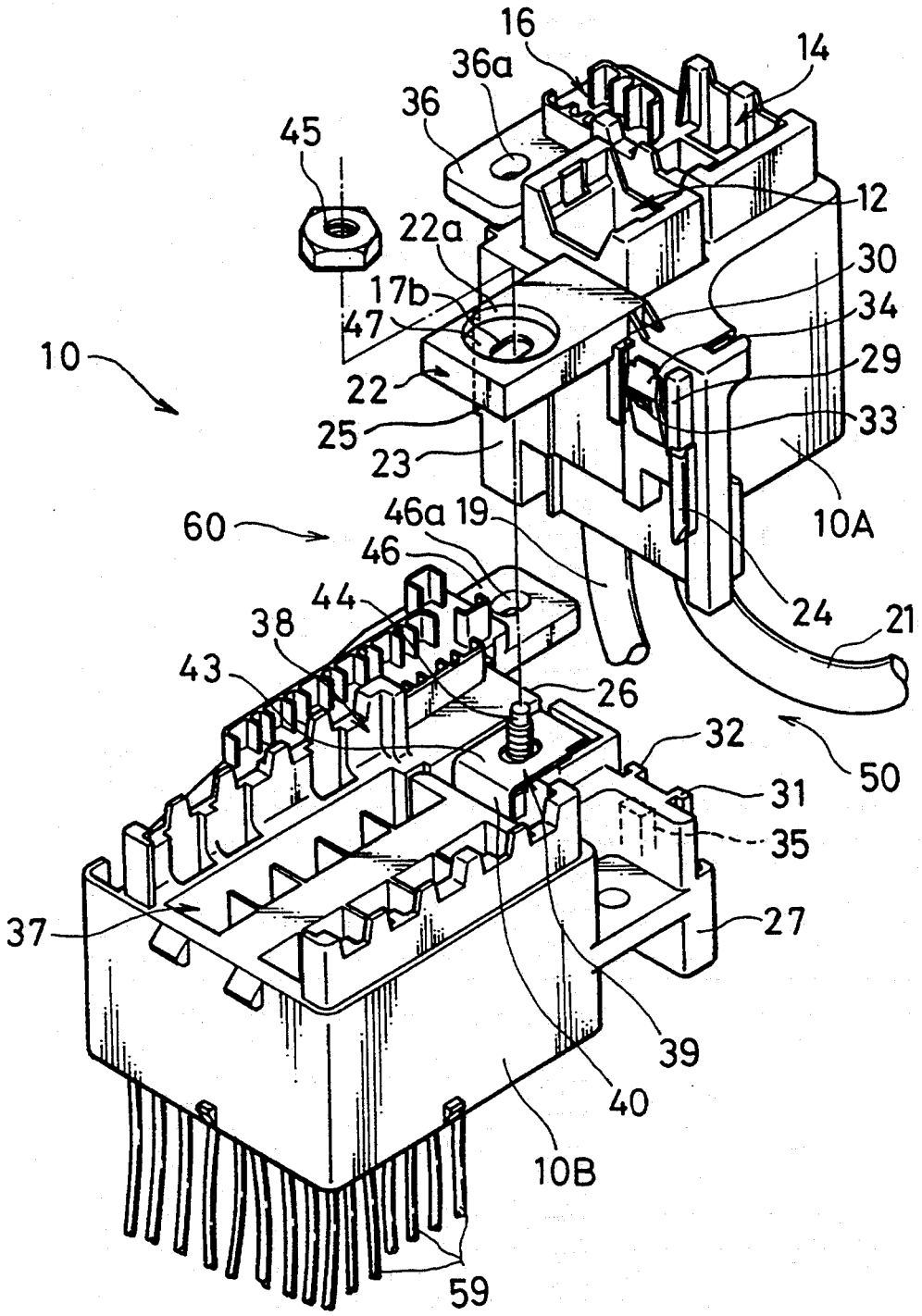
FIG. 1 is an exploded perspective view showing a fuse box related to the present invention.
Figure 2:
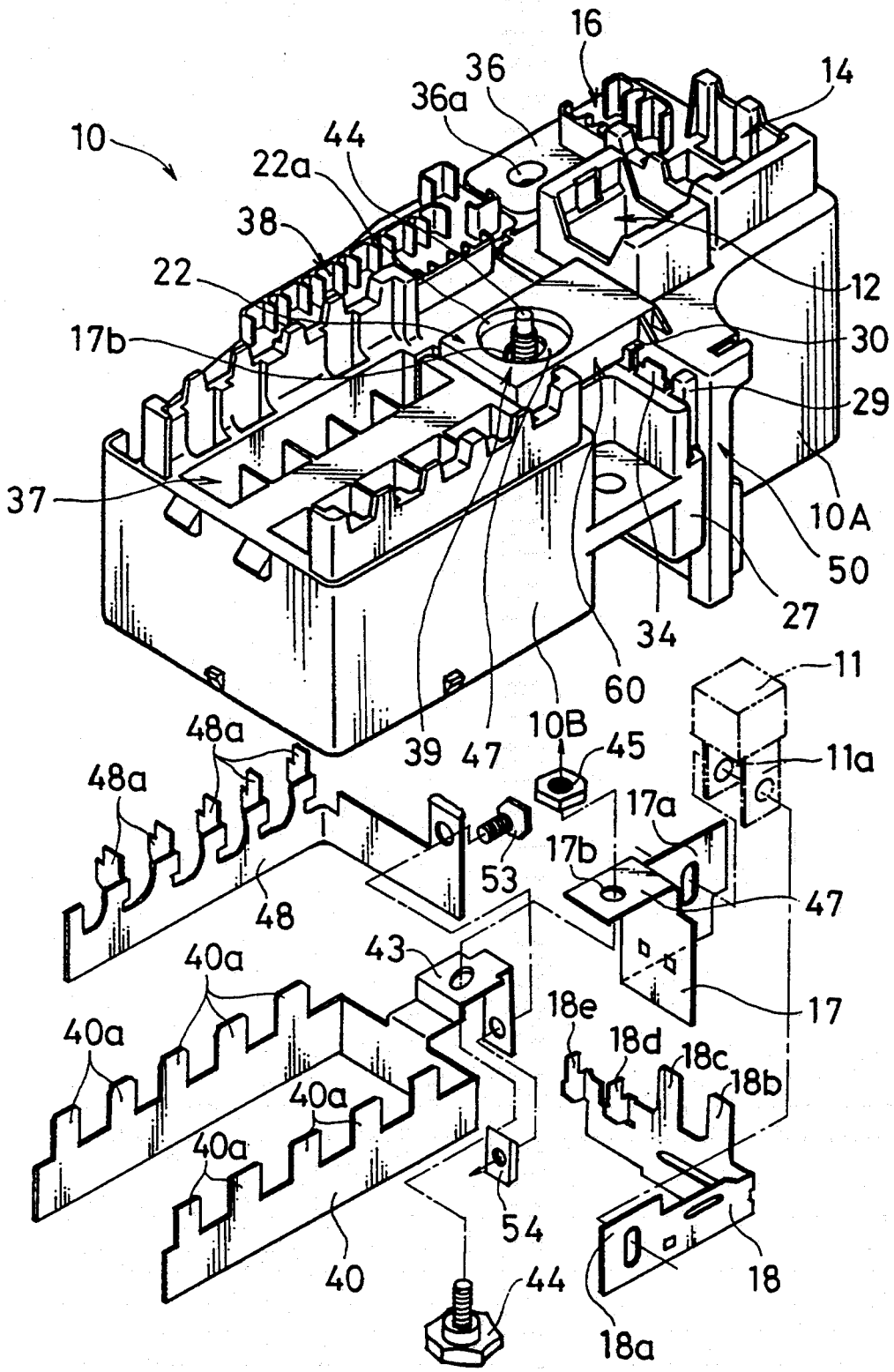
FIG. 2 is a perspective view showing the wiring construction of the fuse box of the present invention.

As shown in FIGS. 1 and 2, the fuse box 10 corresponding to this embodiment is divided into a main power source box 10A to be connected to a battery and a sub-power source box 10B to be used for the current distribution.

Further as shown in FIGS. 1 to 4, the main power source box 10A is substantially cubical, and includes a fuse attaching portion 12 to which a fuse 11 (see FIGS. 2 and 4) of 150A is attached, another fuse attaching portion 14 to which two fuses 13 of 30A are attached, still another fuse attaching portion 16 to which two fuses 15 20A are attached, and a bus bar coupling portion 22 projecting vertically to the face 23 to be in contact with the subpower source box 10B.

In the fuse attaching portion 12 a pair of slits (not shown) are formed in which male-type terminals **11*a* of fuse 11 are inserted, and a pair of insert nuts are embedded respectively crossing these slits. A terminal portion 17*a* of a bus bar 17 projects toward the one of these insert nuts, and a terminal portion 18*a* of another bus bar 18** projects toward the other insert nut.

Figure 3:
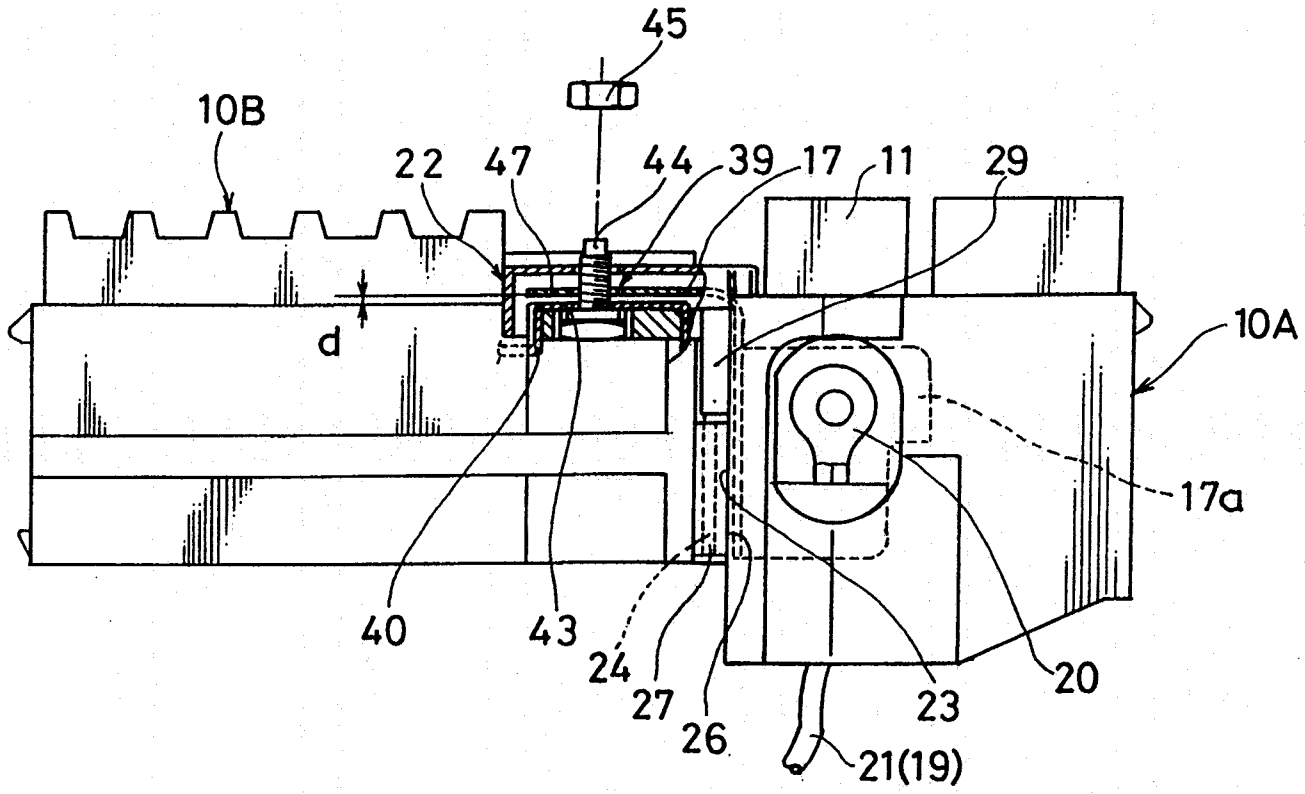
FIG. 3 is a partially sectional side view showing the fuse box of the present invention.
Figure 4:
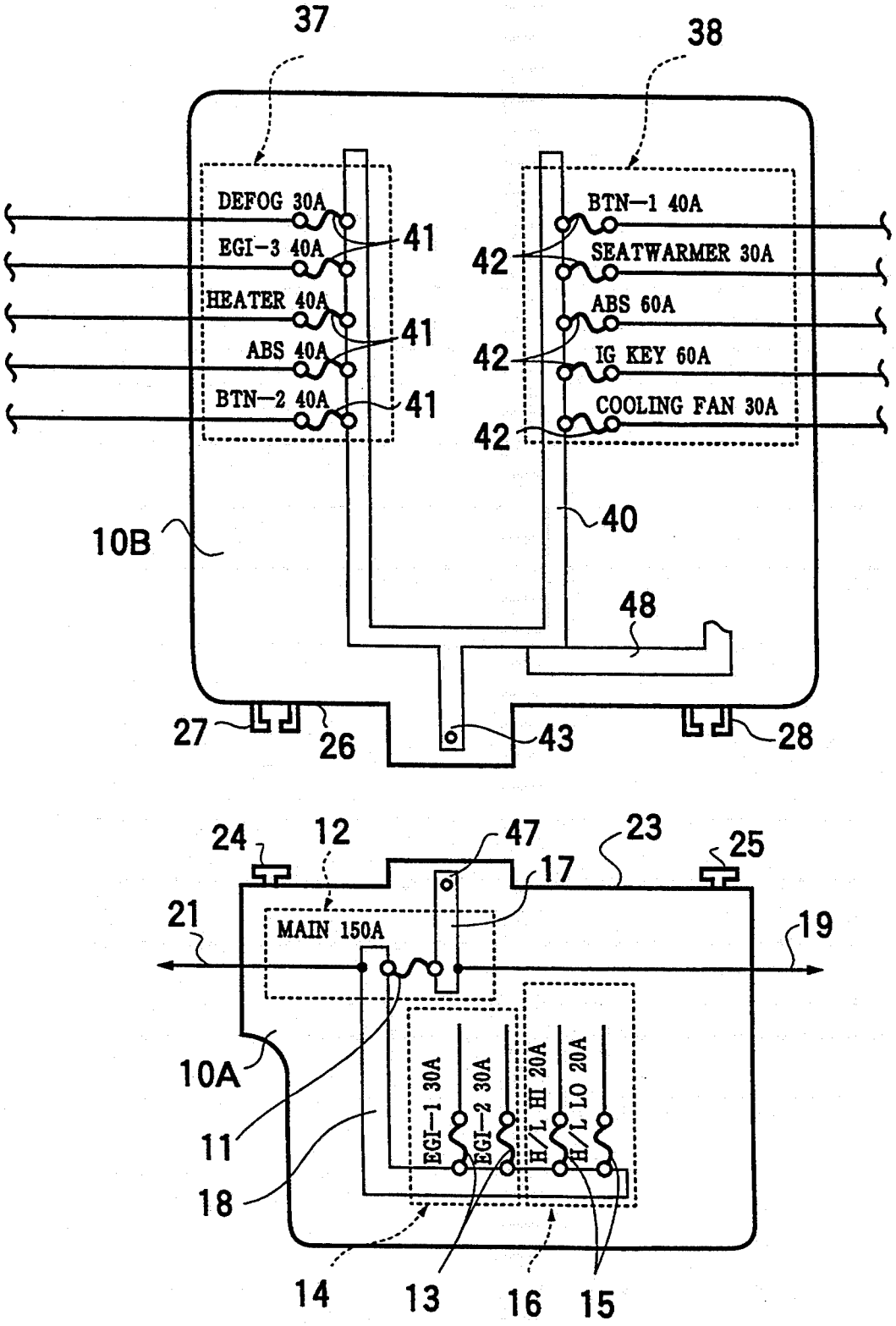
FIG. 4 is a diagram of circuit to be constructed by the bus bar included in the fuse box of the present invention.

Between the terminal portion **17*a* of bus bar 17 and the one insert nut is inserted one of the male-type terminals 11*a* of fuse 11, while the other male-type terminal 11*a* of fuse 11** is inserted between the terminal portion 18*a* of bus bar 18 and the other insert nut. Moreover, as shown in FIG. 3, a terminal 20 of wire 19 connected to the alternator is inserted on the outside of the terminal portion 17*a* of bus bar 17 to connect the wire 19 to the bus bar 17 by screwing a bolt (not shown) into the corresponding insert nut.

On the other hand, a terminal (not shown) of wire 21 connected to the battery is inserted on the outside of the terminal portion 18*a* of bus bar 18 to connect the wire 21 to the bus bar 18 by screwing a bolt (not shown) into the other corresponding insert nut.

Incidentally, each of these wires 19 and 21 has a relatively large diameter and weight because it carries a large current flow.

In the fuse attaching portion 14 are project two male-type terminal portions 18*b*, 18*c* of the bus bar 18 to connect respectively to the wires extending from ignition power sources (EGI-1) and (EGI-2) through each corresponding fuse 13. Also in the fuse attaching portion 16 project two male-type terminal portions 18*d*, 18*e* of the bus bar 18 provided with a Junction terminal at each distal end thereof so as to connect respectively to the wires extending from HEADLIGHT HIGH BEAM (H/L HI) and HEADLIGHT LOW BEAM (H/L LO) through each corresponding fuse 15 (see FIG. 4).

The bus bar coupling portion 22 is a rectangular plate provided with a through-hole 22*a* at its substantially central portion. In the bus bar coupling portion 22 a coupling portion 47 formed at the distal end of bus bar 17 projects, as shown in FIGS. 2 and 3, so as to appear from the through-hole 22*a*. In addition, a through-hole 17*b* smaller than the through-hole 22*a*) is formed in the coupling portion 47.

Moreover, the contact face 23 of main power source box 10A has slide rails 24, 25. These slide rails 24, 25 are fitted respectively in at least one corresponding slide rails 27, 28 formed on the contact face 26 of sub-power source box 10B to mutually slide both the boxes 10A, 10B. Above the slide rail 24 are formed a pair of guide rails 29, 30 having top stopping faces respectively. Also, these guide rails 29, 30 are so constructed as to engage with slide rails 31, 32 formed on the contact face 26 of sub-power source box 10B.

A flexible arm 34 from which a stopping lock nail 33 projects is provided between the guide rails 29, 30. The flexible arm 34 is so formed as to be stopped by a stopping groove 35 provided between the slide rails 31, 32.

In addition, the main power source box 10A includes a rectangular plate flange 36 which extends from the contact face 23 in the same direction as that of bus bar coupling portion 22 and is provided with a through-hole 36*a* at its central portion.

On the other hand, the sub-power source box 10B has a generally rectangular shape, and includes a fuse attaching portion 37 for attachment of fuses 41, a fuse attaching portion 38 for attachment of fuses 42, and a bus bar coupling portion 39.

The fuse attaching portion 37 comprises five attaching sites; from each site project male-type terminals 40*a*, 40*a* . . . formed on a bus bar 40. Incidentally, these attaching sites receive wiring terminals respectively connected to a defogger (DEFOG), an ignition power source (EGI-3), a heater blower (HEATER), an antilock break system (ABS) and a general power source (BTN-2), thereby to connect with the bus bar 40 through each fuse 41 (see FIG. 4).

The fuse attaching portion 38 also comprises fuse attaching sites; from each site project male-type terminals 48*a*, 48*a* . . . of a bus bar 48 connected to the bus bar 40 by bolt 53 and nut 54. These attaching sites receive wiring terminals respectively connected to a general power source (BTN-1), a seatwarmer (SEATWARMER), an antilock break (ABS), an ignition key (IG KEY) and a cooling fan (COOLING FAN), thereby to connect with the bus bar 48 through each fuse 42 (see FIG. 4).

In addition, reference numeral 59 in FIG. 1 designates wires respectively extending to the fuses 41 and 42 and tied up in a suitable bundle so as to connect with each corresponding electric part.

The bus bar coupling portion 39 comprises a coupling portion 48 formed at the distal end of bus bar 40 and a bolt 44 with its head portion disposed below the coupling portion 48 and its thread portion projecting upward therefrom. On the coupling portion 43 is overlapped the bus bar coupling portion 22 of main power source box 10A to fit the bolt 44 in the through-hole 17*b*. Thus, the coupling portion 47 of bus bar 17 is connected electrically with the coupling portion 43 of bus bar 40 by screwing the bolt 44 in the nut 45.

In this case, the coupling portion 47 of bus bar 17 and the coupling portion 43 of bus bar 40 are spaced by a gap d from each other in the state where the contact faces 28, 26 are completely facing each other and the bus bar coupling portion 22 is desiredly overlapped on the bus bar coupling portion 39. Accordingly, when the bolt 44 is screwed into the nut 45, the coupling portions 43, 47 generate the force of counteraction to separate these bolt 44 and nut 45. Therefore, the looseness of nut 45 can be prevented.

Moreover, a flange 46 projects from the contact face 26 of sub-power source box 10B to be overlapped by the flange 36 when the main power source box 10A and sub-power source box 10B are integrated together.

In the above description, the means for mechanically coupling the main power source box 10A and sub-power source box 10B comprises the slide rails 24, 25, 27 and 28, guide rails 29 and 30, slide rails 31 and 32, flexible arm 34, stopping lock projection 33 and stopping groove 35. On the other hand, the means for electrically connecting the main power source box 10A and sub-power source box 10B comprises the coupling portion 47 of bus bar 17, coupling portion 43 of bus bar 40, bolt 44 and nut 45.

When the fuse box 10 having such a divided structure is assembled or integrated in one body, the wire 21 from the battery and the wire 19 from the alternator are connected respectively to the fuse attaching portion 12 on an assembly line at the parts maker, and the main power source box 10A and sub-power source box 10B are then integrated together at the automobile maker by engaging slide rails 24 with 27 and 25 with 28 and by fitting guide rail 29 in slide rail 31 and 30 in 32, respectively.

Further in such an engaged state, the boxes 10A and 10B are slid mutually until their flanges 36, 46 are in contact with each other. When the flanges 36, 46 contact each other, the stopping lock projection 33 is received in the stopping groove 35 to lock both the boxes 10A, 10B. At the same time, the distal end of bolt 44 projecting upward from the bus bar coupling portion 39 is inserted in the through-hole 17*b* of bus bar 17 of bus bar coupling portion 22, and the coupling portion 47 of bus bar 17 and the coupling portion 43 of bus bar 40 face each other with a gap of d.

Next, the nut 45 is screwed up around the bolt 44 so as to make the coupling portion 47 of bus bar 17 and the coupling portion 43 of bus bar 40 contact with each other to connect them electrically.

Thereafter, the so-integrated fuse box 10 is fixed to a predetermined mounting place of each vehicle body through the flanges 36, 46, thereby to complete the mounting work at the automobile maker.

If the main power source box 10A and sub-power source box 10B are removed respectively, the nut 45 is disengaged from the bolt 44 and the stopping lock projection 33 is removed from the stopping groove 35 by bending the flexible arm 34 so as to mutually slide the main power source box 10A and sub-power source box 10B.

Accordingly, the fuse box 10 of this embodiment can facilitate the wiring and assembly works and enhance the productivity on the stage of parts maker by introducing the fuse box 10 into the divided structure as described above.

On the other hand, since the separator boxes 10A, 10B can be connected electrically only by screwing the bolt 44 into the nut 45 and the bolt-screwing work of the above prior art for securing thick wires at many places can be omitted, the mounting workability can be enhanced.

In addition, by providing the mechanical coupling means 50 and the electrical coupling means 60 separately, it becomes possible to carry out highly reliable electrical connection even in the integrated fuse box state.

Incidentally, in the above embodiment, though the means for mechanically coupling both the boxes 10A, 10B uses the slide rails 24, 25, 31, 32 and guide rails 29, 30, it is also possible to adopt the structure other than this one as far as it can couple them together mechanically.

As stated above, since the fuse box of the present invention is divided into a main power source box and a sub-power source box, the mounting work can be carried out with ease. Moreover, since the means for mechanically and electrically coupling these boxes are provided separately in the same inventive fuse box, reliable electrical connection can be guaranteed independent of the mechanical coupling strength.

Various modifications will become possible for those skilled in the art after receiving the teachings of the present disclosure without departing from the scope thereof.

What is claimed is:

1. A fuse box for distributing current derived from a battery through a plurality of fuses, comprising:

a main power source box to be connected to the battery;

a sub-power source box adapted to be mechanically and electrically integrated with said main power source box;

means for mechanically coupling said main power source box with said sub-power source box such that electrical connection therebetween is prevented by a space therebetween; and threaded fastener means for overcoming said space to ensure electrically coupling said main power source box with said sub-power source box.

2. The fuse box according to claim 1, wherein said mechanical coupling means includes means for guiding said main power source box and said sub-power source box mutually along a predetermined direction; and means for stopping mutual movement between said main power source box and said sub-power source box provided by said guide means.

3. The fuse box according to claim 2, wherein said stopping means includes a flexible arm provided in either one of said main power source box and said sub-power source box and a stopping groove provided in the other one thereof, and wherein said arm further includes means for engaging said stopping groove comprising a stopping lock projection.

4. The fuse box according to claim 2, wherein said guide means includes slide rails on the main power source box and slide rails on the sub-power source box adapted for mutual engagement with the main power source slide rails.

5. The fuse box according to claim 2, wherein said electrical coupling means includes a coupling portion on the main power source side formed at a distal portion of a bus bar disposed in said main power source box, a coupling portion on the sub-power source side formed at a distal portion of a bus bar disposed in said sub-power source box, and means for fastening said coupling portion on the main power source side to said coupling portion on the sub-power source side.

6. The fuse box according to claim 1, further comprising a main power source side wire connecting the battery with said main power source box, and a sub-power source side electrical conductor to be connected to said sub-power source box.

7. A fuse box for distributing current derived from a battery through a plurality of fuses, comprising:

a) a main power source box adapted to be connected to the battery;

b) a sub-power source box adapted to be integrated with said main power source box;

c) means for mechanically coupling said main power source box with said sub-power source box, said mechanical coupling means including:

i) means for guiding said main power source box and said sub-power source box mutually along a predetermined direction, said guide means having slide rails on a main power source side of said main power source box and slide rails on a side of said sub-power source box to be engaged with said slide rails on the main power source side; and ii) means for stopping mutual movement between said main power source box and said sub-power source box provided by said guide means, said stopping means having a flexible arm provided in either one of said main power source box and said sub-power source box and a stopping groove provided in the other one thereof, said arm further including a stopping lock projection means for engaging said stopping groove; and d) means for electrically coupling said main power source box with said sub-power source box, said electrical coupling means including:

i) a main power source side coupling portion formed at a distal portion of a first bus bar disposed in said main power source box, ii) a sub-power source side coupling portion formed at a distal portion of a second bus bar disposed in said sub-power source box, and iii) means for fastening said main power source side coupling portion to said sub-power source side coupling portion comprising a bolt and a nut;

wherein said main power source side coupling portion is spaced away from said sub-power source side coupling portion to avoid electrical connection therebetween when mechanical coupling by said mechanical coupling means is accomplished before said fastening means is used, and wherein upon tightening said fastening means the main power source side coupling portion is urged into electrical contact with said sub-power source side coupling portion to provide electrical connection therebetween.

8. The fuse box according to claim 7, further comprising a main power source side wire means for connecting the battery with said main power source box, and a sub-power source side wire means for connecting to said sub-power source box.

9. A fuse box for distributing current derived from a battery through a plurality of fuses, comprising:

a main power source box to be connected to the battery, said main power source box including therein a first electrical bus;

a sub-power source box adapted to be mechanically and electrically integrated with said main power source box, said sub-power source box including therein a second electrical bus;

means for mechanically coupling said main power source box with said sub-power source box to prevent unintentional electrical connection therebetween; and means for electrically coupling said main power source box electrical bus with said sub-power source box electrical bus by overcoming said spatial separation to ensure electrical connection therebetween;

wherein said means for mechanically coupling said main power source box with said sub-power source box provides a resilient spatial separation between said first electrical bus and said second electrical bus; and threaded fastener means for electrically and mechanically locking said buses.

* * * * *